US009776028B2

(12) United States Patent
Feenstra et al.

(10) Patent No.: US 9,776,028 B2
(45) Date of Patent: Oct. 3, 2017

(54) PRE-PRIMED PREACTION SPRINKLER SYSTEM

(75) Inventors: Shawn J. Feenstra, Caledonia, MI (US); Eldon D. Jackson, Hastings, MI (US); Martin H. Workman, Delton, MI (US); Michael J. Bosma, Hastings, MI (US)

(73) Assignee: The Viking Corporation, Hastings, MI (US)

( * ) Notice: Subject to any disclaimer, the term of this patent is extended or adjusted under 35 U.S.C. 154(b) by 1660 days.

(21) Appl. No.: 11/762,179

(22) Filed: Jun. 13, 2007

(65) Prior Publication Data

US 2007/0289751 A1 Dec. 20, 2007

Related U.S. Application Data

(60) Provisional application No. 60/804,711, filed on Jun. 14, 2006.

(51) Int. Cl.

| | |
|---|---|
| ***A62C 35/00*** | (2006.01) |
| ***A62C 35/64*** | (2006.01) |
| ***A62C 35/68*** | (2006.01) |
| ***A62C 37/08*** | (2006.01) |

(52) U.S. Cl.

CPC ..... *A62C 35/645* (2013.01); *A62C 35/68* (2013.01); *A62C 37/08* (2013.01)

(58) Field of Classification Search

USPC ..... 169/16, 17, 5, 43, 7, 8, 61, 19, 18, 60, 169/56, 20, 54, 21, 22

See application file for complete search history.

(56) References Cited

U.S. PATENT DOCUMENTS

| | | | | |
|---|---|---|---|---|
| 2,352,996 | A * | 7/1944 | Rider | 169/17 |
| 3,473,612 | A * | 10/1969 | Poitras | 169/11 |
| 3,762,477 | A * | 10/1973 | Mobley, Sr. | 169/61 |
| 3,878,898 | A * | 4/1975 | Marshall | 169/60 |
| 4,082,148 | A * | 4/1978 | Willms | 169/61 |
| 5,931,233 | A * | 8/1999 | La Bonte et al. | 169/5 |
| 5,971,080 | A * | 10/1999 | Loh et al. | 169/43 |
| 5,979,565 | A * | 11/1999 | Wicks et al. | 169/17 |
| 5,992,532 | A * | 11/1999 | Ramsey et al. | 169/46 |
| 6,263,974 | B1 * | 7/2001 | Sundholm | 169/62 |
| 6,766,835 | B1 | 7/2004 | Fima | |
| 6,848,513 | B2 * | 2/2005 | Jackson et al. | 169/19 |
| 7,026,945 | B2 * | 4/2006 | Hill | 340/652 |
| 7,857,069 | B2 * | 12/2010 | Yu | 169/46 |

(Continued)

*Primary Examiner* — Viet Le

(74) *Attorney, Agent, or Firm* — Harness, Dickey & Pierce, P.L.C.

(57) ABSTRACT

A residential or commercial sprinkler system is provided wherein the sprinkler heads and piping distribution network are provided with a relatively low pressure fire suppressant liquid in place of pneumatic pressure, which is typical, and control valve keeps fire suppressant supply pressure from entering the discharge sprinkler system at design discharge pressure until a fire detection system detects a fire condition. Upon the detection of a fire condition, a control valve is opened to provide the sprinkler heads and piping distribution network with a fully pressurized supply of fire suppressant. Also in the case of electric control power loss the system will operate from loss of outlet supervised pressure releasing sprinkler liquid suppressant to the discharge system of closed fused sprinklers.

32 Claims, 4 Drawing Sheets

(56) References Cited

U.S. PATENT DOCUMENTS

| | | | | |
|---|---|---|---|---|
| 2002/0011342 | A1* | 1/2002 | Reilly | 169/16 |
| 2005/0072580 | A1* | 4/2005 | Jackson | 169/16 |
| 2006/0272830 | A1* | 12/2006 | Fima | 169/16 |

* cited by examiner

PRE-PRIMED PREACTION SPRINKLER SYSTEM

CROSS-REFERENCE TO RELATED APPLICATIONS

This application claims the benefit of U.S. Provisional Application No. 60/804711, filed on Jun. 14, 2006.

FIELD

The present disclosure relates to fire suppressant sprinkler systems and more particularly, to a pre-primed preaction sprinkler system.

BACKGROUND

The statements in this section merely provide background information related to the present disclosure and may not constitute prior art.

Automatic fire protection sprinkler systems are used to protect property and life from damage and loss due to fires. The types of systems that are currently used for residential fire protection are wet systems that include pressurized liquid throughout the piping system using a system check valve and flow alarm. These systems operate when a sprinkler opens due to heat activation of a fusable heat activated link or glass bulb of the sprinkler allows the release of a plug that permits the flow of liquid or fire suppressant until the sprinkler system is manually shut off. Another type of system is a preaction system that includes supervision of discharge system integrity using air, and are typically designed for industrial or commercial applications. The systems designed for industrial or commercial applications are unnecessarily complicated and more costly for residential fire protection. The sprinklers used in residential sprinkler applications are typically evaluated and listed for wet applications only, meaning that the system piping is full of fire suppressant up to the sprinkler head. The industrial and commercial applications require more constraints as required by code and are more demanding on the design. Also, the use of lower cost PVC pipe typical of use in residential sprinkler systems is prohibited for use on air-supervised dry preaction sprinkler systems, unless specific approvals have been obtained from third party laboratory agencies. Constraints that the fire protection codes demand require trained personnel in the field of fire protection to service the existing systems. The designs are more robust for industrial applications due to many factors such as higher system pressure due to bigger supply pumps, to delay in liquid discharge due to replacement of air in the piping system with liquid which requires a substantial amount of time delay.

Wet sprinkler systems are widely used as a cost effective means for residential fire protection systems. Home owners, however, are largely concerned about liquid damage due to accidental discharge of the fire suppressant. Fire suppressant may exit the wet system for many reasons. A pipe could freeze and break, a person could accidentally set off a sprinkler head mechanically, a pin-hole leak may develop in the piping system, or the piping system or sprinkler heads may be otherwise damaged in other ways. The end user is typically concerned about the unintended discharge of fire suppressant liquid while they may be in the dwelling, but more so if they are not within the dwelling for a length of time. Though notification appliances exist, it is still desirable in the art to provide means to address the potential for liquid damage that can occur due to the inadvertent discharge of fire suppressant liquid.

Residential fire sprinkler systems are supplied with liquid from either a municipal water supply main or a local reservoir and pump system separated from the domestic liquid supply system. The sprinkler system is required to include a main supply pipe with liquid flow alarm. The main supply extends up or down to a series of branch pipes that are evenly spaced throughout the protected structure. Dry preaction systems currently exist in which the sprinkler piping network is provided with an air volume that must be depleted before the liquid will discharge from the sprinkler head that has been activated. For large buildings and multiple floor structures, the distance from the typical preaction system control valves can be large, including large volumes of air. If future modifications to the structure are made, and additional sprinklers are added, this can greatly affect the results of the dry system's performance. Also, in addition to the liquid supply system, an air maintenance system is also required to provide supervision of the piping system integrity. The benefit of a dry preaction system is that because the piping network is free from water, the risk of pipe freezing is eliminated. However, the complexity of maintaining the air maintenance system significantly increases the cost of the system. Furthermore, the inadvertent breaking of a sprinkler head would typically trigger activation of the control valve allowing the release of full flow of fluid through the piping system.

In the fire protection sprinkler industry, wet systems utilize a flow switch and check valve combination to provide an alarm to indicate when a flow condition is present. With a typical wet system, that includes a check valve style valve wherein liquid pressure in the system holds the check valve closed until an open device in the piping system, such as a fused sprinkler, opens allowing liquid to flow. The check valve will open allowing full system pressure and liquid flow to enter the piping system and discharge from the piping and sprinklers. Typical preaction systems currently available that use a flow control valve held closed by system supply liquid pressure require air supervision of the system piping and additional air pressure maintenance systems. Accordingly, it is desirable in the art to provide a less complex fire suppressant sprinkler system that is capable of providing immediate protection of a protected area but provides effective limitations on the amount of fire suppressant liquid inadvertently discharged from the sprinkler system.

SUMMARY

The present disclosure provides a fire protection sprinkler system, including a pressurized liquid supply, a plurality of sprinkler heads connected to a piping network and means for connecting the pressurized liquid supply to the piping network in a first mode so as to maintain the piping network at a first pre-primed pressure, and in a second mode so as maintain said piping network at a second preaction pressure greater than the first pre-primed pressure. The second mode can be activated by activation of a smoke or heat detection device. The means for connecting further includes a restricted liquid supply passage connecting the pressurized liquid supply with the piping network, wherein the second mode can be activated by a loss of electrical power. The means for connecting may also include a control valve provided in a closed position in the first mode, and which is opened in the second mode. The control valve includes a prime chamber that receives the first pre-primed pressure for holding the control valve in the closed position. The means for connecting may also include a normally open solenoid valve communicating the first pre-primed pressure with the prime chamber of the control valve. The normally open solenoid valve can be activated in response to the detection of a fire condition so as to interrupt the flow of fluid to the prime chamber of the control valve, allowing the control valve to open and thereby provide full pressurized water supply to the piping network.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
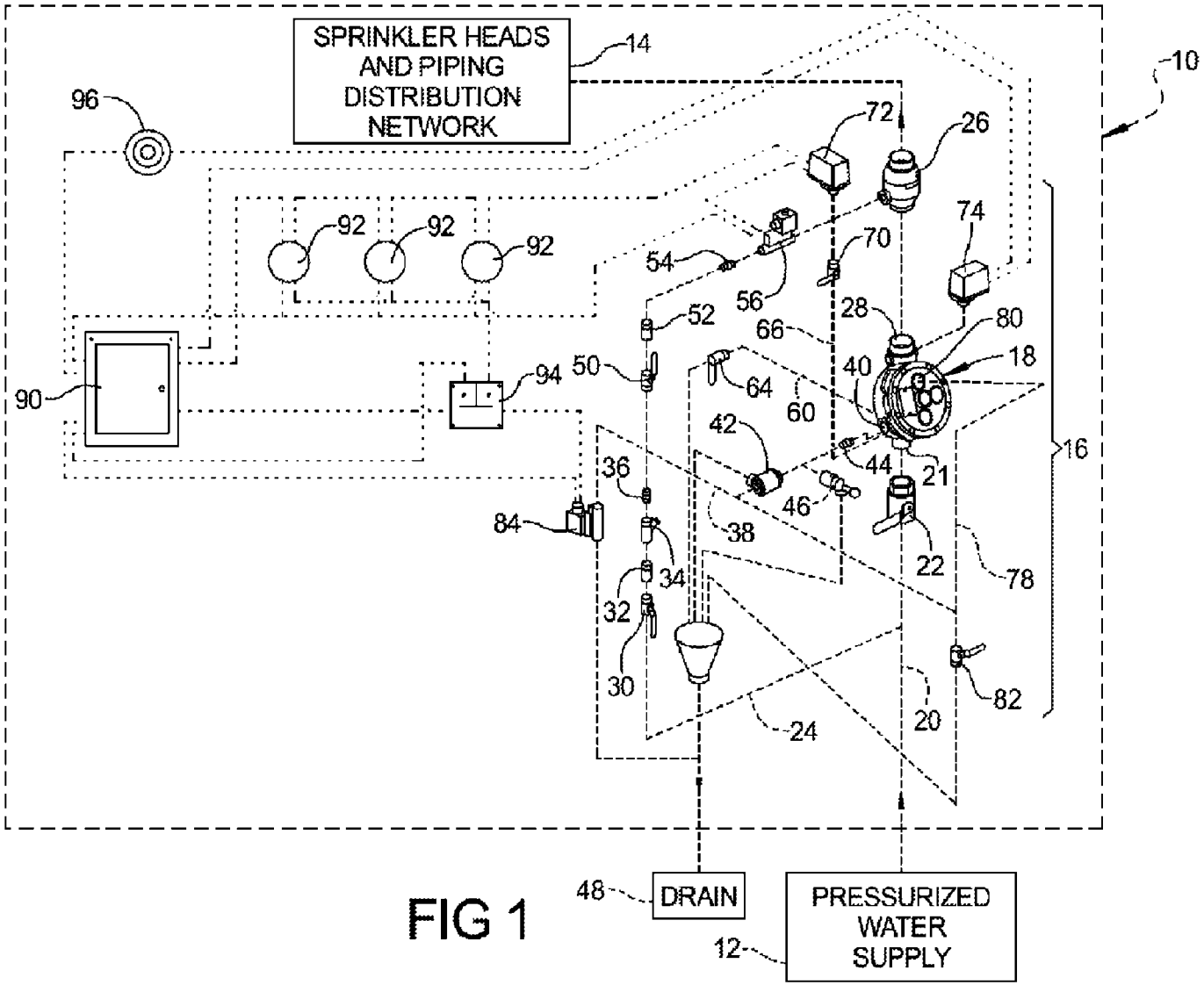
FIG. 1 is a schematic diagram of a pre-primed preaction sprinkler system according to the principles of the present disclosure.

The following description is merely exemplary in nature and is not intended to limit the present disclosure, application, or uses. It should be understood that throughout the drawings, corresponding reference numerals indicate like or corresponding parts and features.

With reference to FIG. 1, a residential pre-primed preaction system, according to the principles of the present disclosure, will now be described. The residential pre-primed preaction system is provided in a dwelling 10 and includes a pressurized water supply 12 that supplies water or, alternatively, other fire suppressant liquids to a plurality of sprinkler heads of a sprinkler head and piping distribution network 14. The plurality of sprinkler heads 14 are preferably appropriately spaced throughout the dwelling 10, or other building, which can include a residential home, multi-dwelling unit, commercial or industrial building. A connection system 16 is provided for connecting the pressurized liquid supply 12 to the piping distribution network and sprinkler heads 14.

The connection system 16 includes a flow control valve 18 connected to the pressurized water supply 12 by a main supply line 20. A manual supply valve 22 can be provided in the main supply line 20 in order to manually interrupt supply of the pressurized water supply to the flow control valve 18. A restricted liquid supply passage 24 is also connected to the pressurized water supply 12 and to the sprinkler heads and piping distribution network 14 in order to supply the sprinkler heads with a relatively low pre-primed pressure of liquid suppressant.

A check valve 26 is provided to prevent the backflow of liquid suppressant from the sprinkler heads and piping distribution network 14. The one-way check valve 26 is connected to the outlet 28 of the flow control valve 18 and to the restricted liquid supply passage 24. The restricted liquid supply passage 24 is provided with a prime line valve 30 that allows manual shut-off of the restricted liquid supply passage 24. A check valve 32 is provided downstream from the prime line valve 30 in order to prevent reverse flow of liquid suppressant in the restricted liquid supply passage 24. A strainer 34 can also be provided in order to remove debris from the liquid suppressant in order to prevent clogging of the restricted liquid supply passage 24. The strainer 34 can be provided with a clean-out access to allow easy maintenance of the strainer 34 to make sure that the strainer does not itself become clogged. A restricted orifice 36 is provided downstream from the strainer 34 and restricts the flow of liquid suppressant through the restricted liquid supply passage 24.

A control passage 38 is provided in connection with the restricted liquid supply passage 24 and a prime chamber 40 of flow control valve 18. The control passage 38 is provided with a pressure operated relief valve 42 and a reset orifice 44. A drip check reset valve 46 is provided in communication with the control passage 38 and is in communication with a drain 48.

A maintenance valve 50 can be provided in the restricted liquid supply passage 24 downstream from the control passage 38. The maintenance valve 50 can be manually operated for shutting off the restricted liquid supply passage at a location downstream from the control passage 38, to allow maintenance to be performed downstream thereof if necessary. A check valve 52 is provided downstream of the maintenance valve 50 and a maintenance orifice 54 can also be provided in the restricted liquid supply passage 24 downstream of the check valve 52.

A normally open solenoid valve 56 is provided in the restricted liquid supply passage 24 at a location downstream from the control passage 38 and prior to the check valve 26. A main drain passage 60 is provided in communication with a drain port 62 (best shown in FIG. 2) in communication with the inlet chamber 21 of the flow control valve 18. A main drain valve 64 is provided in the main drain passage 60 which communicates with drain 48. Main drain valve 64 can be manually operated to divert flow from the pressurized water supply 12 to the drain 48.

A supervisory passage 66 can be provided in communication with restricted liquid supply passage 24 at a location downstream of the normally open solenoid 56 and in communication with a port 68 provided in communication with the inlet chamber 21 of the flow control valve 18. The supervisory passage 66 is provided with a manually controlled by-pass valve 70 and a supervisory pressure switch 72. An electric flow switch 74 is provided in connection with the outlet passage 28 of the flow control valve 18. The electric flow switch 74 detects the flow of pressurized liquid suppressant through the flow control valve 18, and provides an appropriate signal to the normally open solenoid valve 56, as will be described in greater detail herein.

An emergency release passage 78 is provided in communication with an emergency release port 80 which communicates with the prime chamber 40 of the flow control valve 18. The emergency release passage 78 is provided with an emergency release valve 82 that can be manually operated to permit the flow of liquid suppressant to the drain 48. A normally closed solenoid valve 84 is provided in communication with the restricted liquid supply passage 24 and can be controlled to an open position to allow drainage of liquid suppressant from the restricted liquid supply passage 24 to the drain 48.

A main electrical system is provided, including a main breaker panel 90 which can include the residential main breaker panel, or a supplementary main breaker panel dedicated to the sprinkler system. A plurality of smoke detectors and/or heat detectors 92 are provided in electrical connection with the main breaker panel 90. It should be understood that the smoke detectors and/or heat detectors 92 provide presently known fire detection mechanisms, although other fire detection mechanisms may be utilized with the present disclosure. The fire detection mechanisms 92 are electrically connected to the supervisory pressure switch 72 and normally open solenoid valve 56. In addition, power relay switch 94 is provided in connection with fire detection mechanisms 92 and main breaker panel 90 and when activated, provides an activation current to normally closed solenoid valve 84 to open the valve 84 to allow drainage of the restricted liquid supply passage 24 to the drain 48. The electric flow switch 74 is electrically connected to the main breaker panel 90 and a flow alarm device, such as a bell or light indicator or other known alarm mechanism 96 so that upon detection of pressurized liquid through the flow control valve 18, the electric flow switch 74 is triggered closed in order to provide a closed circuit for activating the flow alarm 96 for indicating to the dwelling inhabitants that the sprinkler heads and piping distribution network 14 have been pressurized to a preaction pressure.

Figure 2:
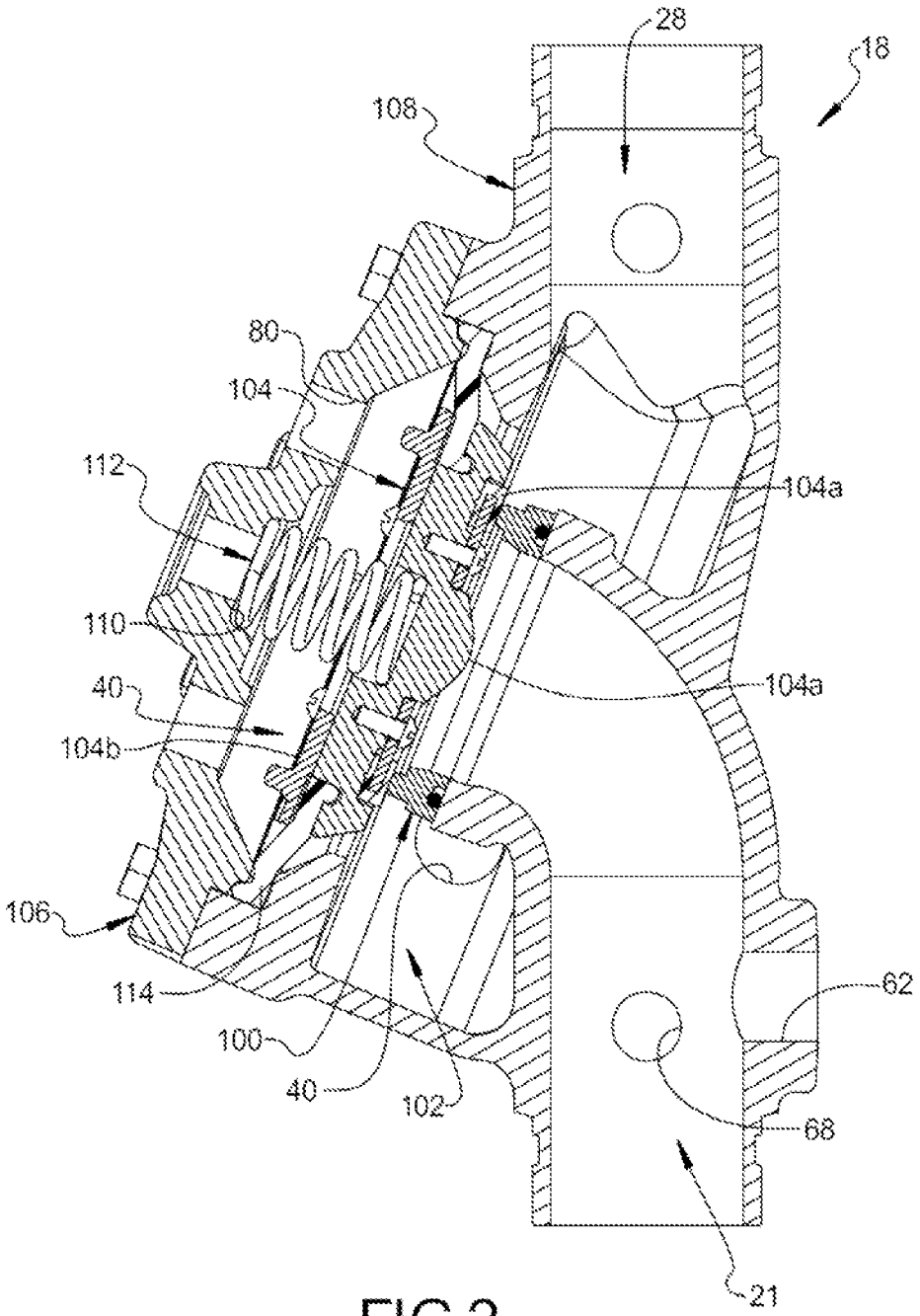
FIG. 2 is a cross-sectional view of an exemplary control valve with use with the pre-primed preaction sprinkler system according to the principles of the present disclosure.

With reference to FIG. 2, the flow control valve 18 will now be described in greater detail. The flow control valve 18 includes an inlet chamber 21 and an outlet chamber 28. A valve seat 100 is provided at an interface between an intermediate chamber 102 and the inlet chamber 21. The outlet chamber 28 communicates with the intermediate chamber 102. The valve seat 100 is engaged by a clapper assembly 104 which is disposed against the valve seat 100 on a first side 104*a* thereof, and exposed on a second side 104*b* thereof to the prime chamber 40 of the flow control valve 18. A cover 106 is mounted to the valve body 108 and defines a boundary for the prime chamber 40. The cover 106 also includes a spring seat 110 which receives a spring 112 which acts to bias the clapper assembly 104 to a closed position.

The clapper assembly 104 can include a flexible diaphragm fixedly connected to the clapper assembly and fixed between the cover 106 and valve body 108. Diaphragm 114 provides a fluid tight partition for separating the prime chamber 40 from intermediate chamber 102. The size of the exposed surface of the first side 104*a* of the clapper assembly that is exposed to the pressurized liquid introduced to the inlet chamber 21 can be selected along with the surface exposure on the second side 104*b* of the clapper assembly 104 within the prime chamber so as to provide a pressure ratio that, in combination with spring 112, allows the clapper assembly 104 to be seated against valve seat 100 when the prime pressure is applied to the prime chamber 40 and the pressurized fluid supply is in communication with the inlet chamber 21 of the flow control valve 18. By way of example, a pressure ratio of approximately 2:1 can be provided to allow the prime pressure from the restricted liquid flow passage 24 to maintain the clapper assembly 104 in a closed position opposing the pressurized liquid supply provided through the inlet chamber 21. In addition, the spring force of spring 112 can supplement the prime pressure for holding the clapper assembly 104 in a closed position. The pressure of the pressurized liquid supply 12, the spring force of spring 112 and the pressure of the restricted liquid supply 24 can be specifically designed according to a desired application.

During installation of the residential pre-primed preaction system, the connection system 16 is connected to the sprinkler heads and piping distribution network 14 and to the pressurized water supply 12 taking into consideration local fire protection requirements. The local requirements may dictate the supply design to be supervised, separate from household appliances or other restrictions. The fire detection devices 92 are preferably wired to the power supply 90. The power supply 90 may be the main breaker panel or an independent source including an AC/DC converter with battery backup. A travel wire is connected on the detectors 92 and to the power relay 94 that controls the power of the normally closed solenoid valve 84. The power supply 90 is also connected to the power relay 94 for the normally closed solenoid valve 84. The normally closed solenoid valve 84 is connected to a common contact on the power supply 90. The lead wire from the detectors 92 is connected to the normally closed contact of the supervisory pressure switch 72. The common contact of the supervisory pressure switch is connected to the normally open solenoid valve 56 and the normally open solenoid valve 56 is connected to a common contact of the power supply 90. The power supply 90 is also connected to the normally open contact of the electric flow switch 74. The common contact of the electric flow switch 74 is connected to the alarm 96 which is connected to a common contact of the power supply 90.

The prime line valve 30 can be moved to a closed position in order to place the liquid supply control valve 18 in the system in service. At this point, liquid suppressant is provided at the liquid supply control valve 22 and the bypass valve 70 and maintenance valve 50 are closed to prevent liquid from entering the sprinkler system. The emergency release valve 82 is also closed to prevent the prime line from draining. The prime line valve 30 is then opened to pressurize the flow control valve 18 to a closed position. The main drain valve 64 is then closed to prevent discharge of suppressant to the drain 48. The liquid supply control valve 22 can then be opened to pressurize the inlet of the flow control valve 18. The bypass valve 70 is then opened to pressurize the sprinkler heads and piping distribution network 14 to a prime pressure. The bypass valve 70 can then be closed when the sprinkler system is pressurized. The maintenance valve 50 can then be opened to keep the sprinkler system pressurized. The system is now in service.

During the static condition, the pressure in the sprinkler system is maintained through the restricted liquid supply passage 24, maintenance valve 50, check valve 26, maintenance orifice 54, and normally opened solenoid valve 56. The flow control valve 18 remains closed due to the pressure trapped in the prime chamber 40 while the pressure operated relief valve 42 and normally closed solenoid valve 84 each remain closed, and each of the sprinkler heads have not been activated.

In the event of a fire, the detectors 92 will close the contacts of the power relay 94 and cause the normally closed solenoid valve 84 to open which allows the restricted liquid supply passage 24 to connect to drain 48. This releases the prime pressure holding the flow control valve 18 closed and thus allows the flow control valve 18 to open. In particular, the prime pressure is released from the prime chamber 40 thus allowing the pressure of the pressurized water supply to overcome the spring force of spring 112 allowing the clapper assembly 104 to be unseated from seat member 100 so that liquid suppressant will enter the empty intermediate chamber 102 of the flow control valve 18. This will close the normally open contacts of the electric flow switch 74 and cause an audible and/or visible signal to be emitted from alarm 96. Further, opening of the flow control valve 18 will pressurize the sensing end of the pressure operated relief valve 42 to constantly drain the pressure from the prime line (restricted liquid supply passage 24) and keep the flow control valve 18 open. The heat from the fire will open the thermally responsive elements of any of the sprinkler heads located in proximity to the fire. This will allow the suppressant to be discharged through the sprinkler heads which become activated.

In the case of non-fire related detector operation, the fire detecting devices 92 can be used as the initiating device to operate the flow control valve. A common cause for smoke detector operation is burning food in the kitchen. The smoke detectors can be activated from this condition, although the sprinkler heads may not operate. When the detection devices 92 operate in such conditions that are not fire related, the flow control valve 18 will still operate, though no suppressant will flow from the sprinkler system, and the alarm 96 will still notify the building inhabitants of the pressurized sprinkler system. When it is determined that there is no fire, the flow control valve 18 can be reset. Simply depressing the plunger of the drip check/reset valve 46 can reset the flow control valve to the closed position since the reset orifice 44 limits the flow to the sensing end of the pressure operated relief valve 42. The drip check/reset valve 46 drains the suppressant faster than can be supplied through the reset orifice 44. This depressurizes the sensing end of the pressure operated relief valve 42 and allows the pressure operated relief valve 42 to cease draining the prime line 24. The prime line 24 will then be allowed to pressurize the flow control valve to a closed position. The system is now returned in service with the normally closed solenoid valve 84 in its normally closed position, assuming that the detection devices 92 have ceased being activated.

Accidental discharge from the sprinkler system can be caused by several means. If the suppressant discharges from the sprinkler system prior to the flow control valve 18 operating, the pressure in the sprinkler system depletes. Flow of the sprinkler system needs to be greater than the flow being supplied through the prime line restricted orifice in order to deplete the sprinkler system pressure. The supervisory pressure switch 72 will close its relay at a predetermined pressure and power the normally open solenoid valve 56 to a closed position. The supervisory pressure switch 72 will close the normally open solenoid 56 before the pressure in the prime line is depleted enough to operate the flow control valve 18. The maintenance orifice 54 retards the pressure decay rate. This prevents the flow control valve 18 from operating when a rapid pressure reduction occurs.

This system prevents liquid damage from occurring due to accidental sprinkler system discharge. In particular, in the event of accidental sprinkler system discharge, only the liquid suppressant in the piping distribution network will drain from the sprinkler head and piping distribution network 14 which typically would be limited to a few gallons, whereby damage from this relatively small amount of liquid is minimal.

In the event the power is not being supplied to the detection devices 92, the system changes to a hydraulically latched pre-action system. If a fire exists, the thermally responsive element of the sprinkler heads will operate and deplete the sprinkler system pressure supplied through the prime line 24. The sprinkler system 14 will be supplied with suppressant through the prime line 24 at a relatively low pressure. The prime line 24 will not be able to match the flow rate of the sprinkler head, thus the pressure in the prime line 24 will deplete and cause the flow control valve 18 to operate to an open position. The supervisory pressure switch 72 will not have power supplied to it, therefore, it will not close the normally open solenoid valve 56. The trouble horn 96 may not have power to create the signal indicating operation of the flow control valve 18. The normally closed solenoid valve 84 may still be in operation if the detector has battery backup and power is still supplied to the power relay. This would be the case for smoke detectors that have batteries as a backup power supply. Detectors 92 are wired in series such that the lead wire will be disconnected if any of the detectors are removed. This prevents the normally open solenoid valve 56 from being able to operate, and allows the system to operate due to either detection or depleting sprinkler system pressure.

The system of the present disclosure combines the use of a wet system and control valve to provide immediate protection of protected areas providing liquid dispersion to the sprinklers and maintains supervision of the piping system using the main liquid supply or auxiliary liquid and pump supply. It also uses the existing requirement of smoke or heat detection devices to notify persons for egress and opens or activates the control valve for full supply of required fire suppressant. In addition to fire protection, in non-fire liquid leakage conditions, the control valve 18 remains closed to minimize liquid damage caused by open sprinklers or pipe system damage in non-fire related incidents. Only the liquid stored in the pipe system will drain from the open pipe or sprinkler and will not discharge liquid supplied under pressure.

Figure 3:
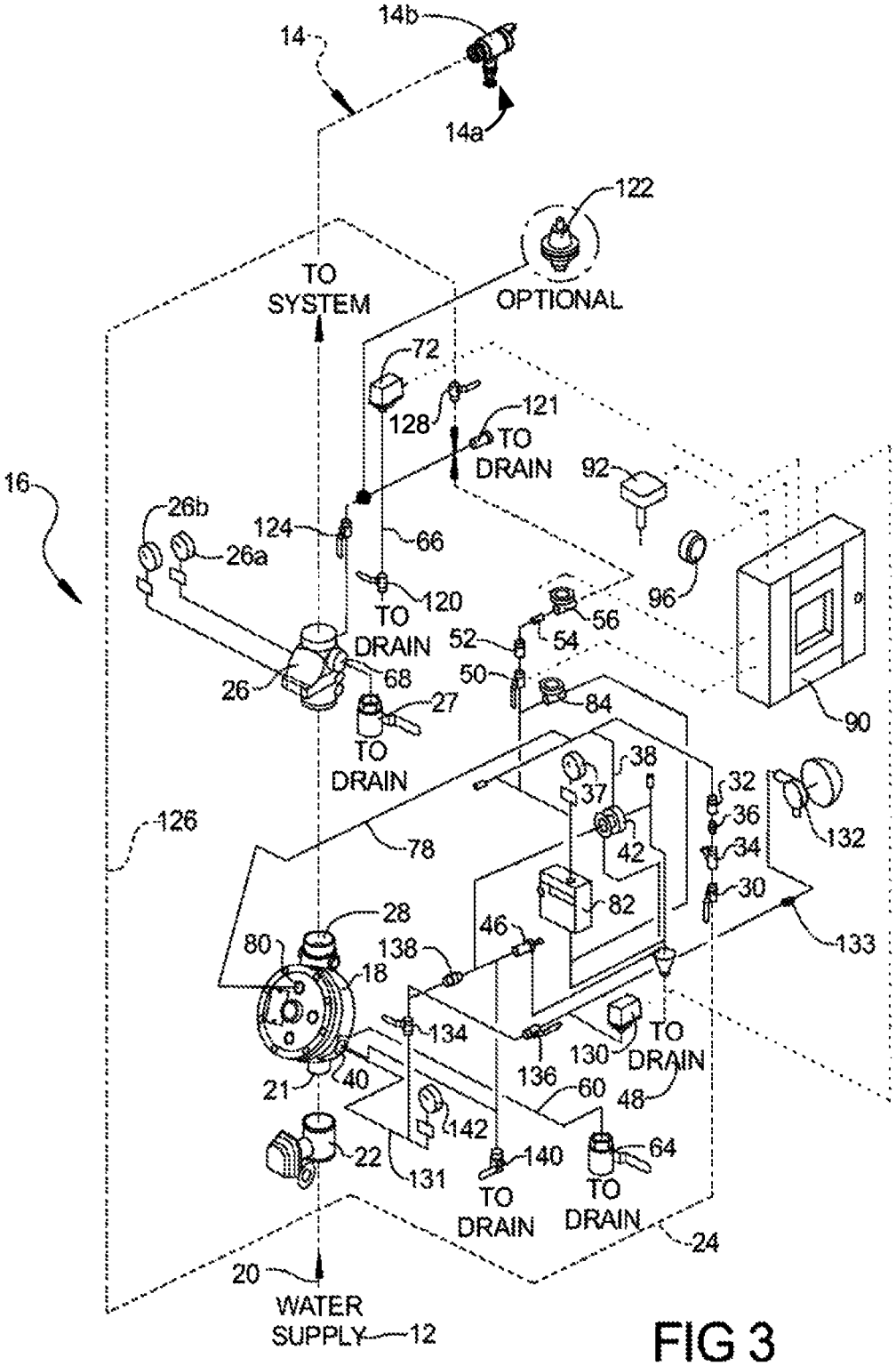
FIG. 3 is a schematic diagram of a pre-primed preaction sprinkler system according to a second embodiment of the present disclosure.

With reference to FIG. 3, a pre-primed preaction system, according to a further embodiment of the present disclosure, will now be described, wherein the same reference numerals are utilized to represent the same or similar components as described above. The pre-primed preaction system is provided in a dwelling or other building, which can include a residential home, multi-dwelling unit, commercial or industrial building and includes a pressurized water supply 12 that supplies water or, alternatively, other fire suppressant liquids to a plurality of sprinkler heads 14*a* of a sprinkler head and piping distribution network 14. The plurality of sprinkler heads 14*a* are preferably appropriately spaced throughout the dwelling 10. The sprinkler head and piping distribution network 14 can also include an automatic air vent 14*b*, as is known in the art. A connection system 16 is provided for connecting the pressurized liquid supply 12 to the piping distribution network 14 and sprinkler heads.

The connection system 16 includes a flow control (deluge) valve 18 connected to the pressurized water supply 12 by a main supply line 20. A manual supply valve 22 can be provided in the main supply line 20 in order to manually interrupt supply of the pressurized water supply 12 to the flow control valve 18. A restricted liquid supply passage 24 is also connected to the pressurized water supply 12 and to the sprinkler heads and piping distribution network 14 in order to supply the sprinkler heads with a relatively low pre-primed pressure of liquid suppressant.

A check valve 26 is provided to prevent the backflow of liquid suppressant from the sprinkler heads and piping distribution network 14. The one-way check valve 26 is connected to the outlet 28 of the flow control valve 18 and to the restricted liquid supply passage 24. The one-way check valve 26 can include a system pressure gauge and valve 26*a* for detecting the downstream pressure and a pressure gauge and valve 26*b* for detecting upstream pressure. A system main drain valve 27 allows the piping distribution network 14 to be drained. The restricted liquid supply passage 24 is provided with a prime line valve 30 that allows manual shut-off of the restricted liquid supply passage 24. A check valve 32 is provided downstream from the prime line valve 30 in order to prevent reverse flow of liquid suppressant in the restricted liquid supply passage 24. A strainer 34 can also be provided in order to remove debris from the liquid suppressant in order to prevent clogging of the restricted liquid supply passage 24. The strainer 34 can be provided with a clean-out access to allow easy maintenance of the strainer 34 to make sure that the strainer does not itself become clogged. A restricted orifice 36 is provided downstream from the strainer 34 and restricts the flow of liquid suppressant through the restricted liquid supply passage 24. A priming pressure water gauge and valve 37 is provided in communication with the restricted liquid supply passage 24.

A control passage 38 is provided in connection with the restricted liquid supply passage 24 and a prime chamber 40 of flow control valve 18. The control passage 38 is provided with a pressure operated relief valve 42. A drip check reset valve 46 is provided in communication with the control passage 38 and is in communication with a drain 48.

A maintenance valve 50 can be provided in the restricted liquid supply passage 24 downstream from the control passage 38. The maintenance valve 50 can be manually operated for shutting off the restricted liquid supply passage at a location downstream from the control passage 38, to allow maintenance to be performed downstream thereof if necessary. A check valve 52 is provided downstream of the maintenance valve 50 and a maintenance orifice 54 can also be provided in the restricted liquid supply passage 24 downstream of the check valve 52.

A normally open solenoid valve 56 is provided in the restricted liquid supply passage 24 at a location downstream from the control passage 38 and prior to the check valve 26.

A main drain passage 60 is provided in communication with a drain port 62 (best shown in FIG. 2) in communication with the inlet chamber 21 of the flow control valve 18. A main drain valve 64 is provided in the main drain passage 60 which communicates with drain 48. Main drain valve 64 can be manually operated to divert flow from the pressurized water supply 12 to the drain 48.

A supervisory passage 66 can be provided in communication with restricted liquid supply passage 24 at a location downstream of the normally open solenoid 56 and in communication with a port 68 provided in communication with the check valve 26. A supervisory pressure switch 72 is in communication with the supervisory passage 66. The supervisory passage 66 is provided with a manually controlled supervisory alarm test valve 120 and a pressure relief valve 121 can also be provided. By opening alarm test valve 120, a pressure drop should be detected by supervisory pressure switch 72 which can be confirmed by an operator testing the system. A pilot pressure regulating valve 122 can also be utilized to regulate the pressure of the restricted liquid supply passage 24. A normally open maintenance valve 124 is also provided in the supervisory passage 66. A by-pass line 126 including a by-pass isolation valve 128 can also be provided in communication with the water supply 12 and restricted liquid supply passage 24.

An alarm pressure switch 130 can be provided in an alarm passage 131 in connection with the prime chamber 40 of the flow control valve 18 and/or a water motor alarm 132 can be utilized in connection with the alarm passage 131. A strainer 133 can be provided up-stream of the water motor alarm 132. The alarm pressure switch 130 detects a reduction of pressure in the liquid suppressant supplied to the prime chamber 40 of the flow control valve 18, and provides an appropriate signal to the control panel 90. A normally closed alarm test valve 134 and a normally open alarm shut off valve 136 are provided for testing and for isolating the alarm system. A drain check valve 138 is provided between a normally closed auxiliary drain valve 140 and the alarm test valve 134. A water supply pressure gauge and valve 142 is provided in the alarm passage 131.

An emergency release passage 78 is provided in communication with an emergency release port 80 which communicates with the prime chamber 40 of the flow control valve 18. The emergency release passage 78 is provided with an emergency release valve 82 that can be manually operated to permit the flow of liquid suppressant to the drain 48. A normally closed solenoid valve 84 is also provided in communication with the restricted liquid supply passage 24 and can be controlled to an open position to allow drainage of liquid suppressant from the restricted liquid supply passage 24 to the drain 48.

A main electrical system is provided, including a main breaker panel 90 which can include the residential or commercial main breaker panel, or a supplementary main breaker panel dedicated to the sprinkler system. A plurality of smoke detectors and/or heat detectors 92 are provided in electrical connection with the main breaker panel 90. It should be understood that the smoke detectors and/or heat detectors 92 provide presently known fire detection mechanisms, although other fire detection mechanisms may be utilized with the present disclosure. The fire detection mechanisms 92 are electrically connected to the control panel 90. The main control panel 90 provides an activation current to normally closed solenoid valve 84 to open the valve 84 to allow drainage of the restricted liquid supply passage 24 to the drain 48. The main breaker panel 90 also provides a signal to the flow alarm device, such as a bell or light indicator or other known alarm mechanism 96 for indicating to the dwelling inhabitants that the sprinkler heads and piping distribution network 14 have been pressurized to a preaction pressure. The operation of the connection system 16 of FIG. 3 is generally the same as described above with respect to FIG. 1, with the addition of multiple pressure gauges, testing, draining and maintenance features as described.

Figure 4:
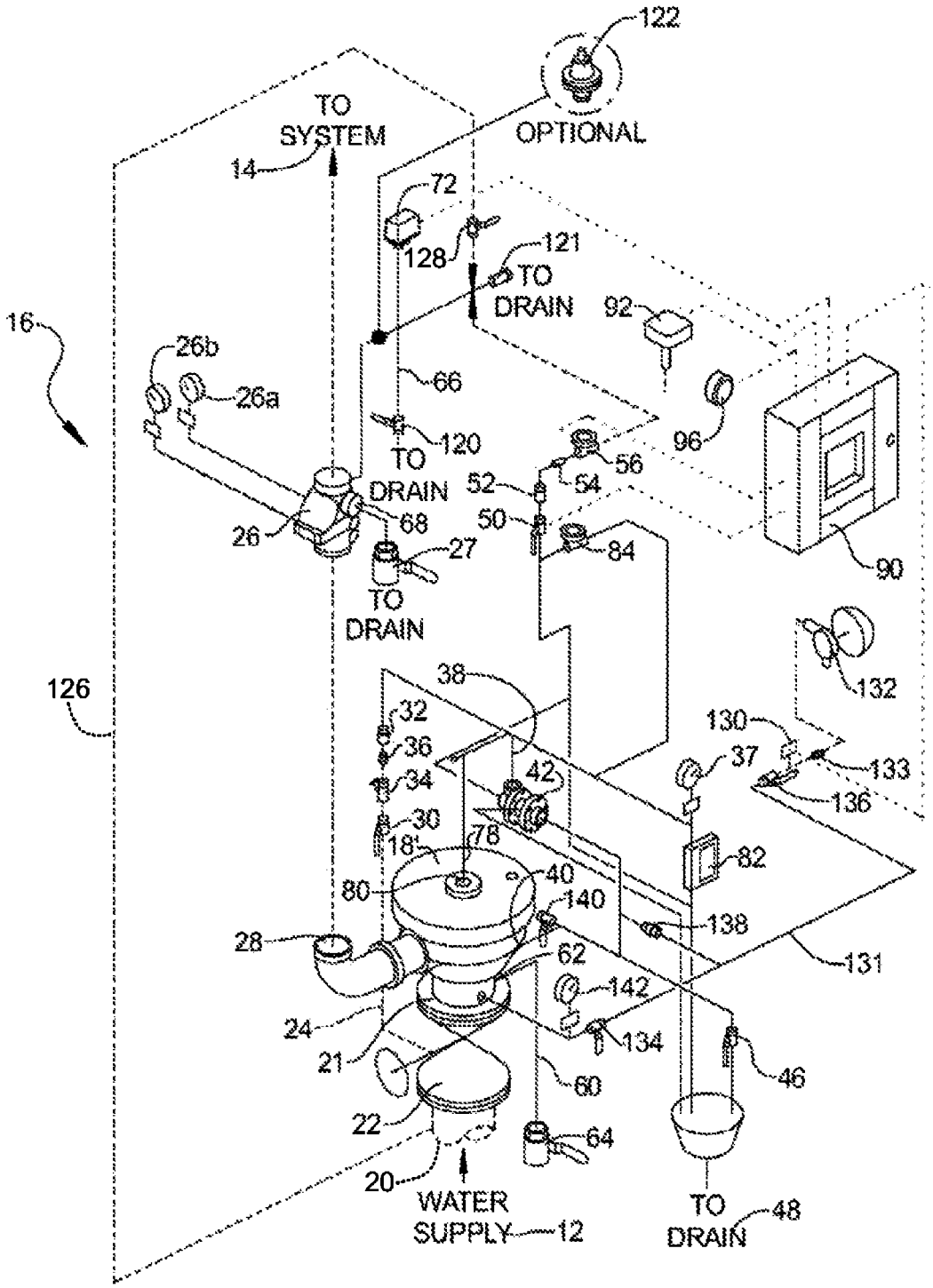
FIG. 4 is a schematic diagram of a pre-primed preaction sprinkler system according to a third embodiment of the present disclosure.

With reference to FIG. 4, a pre-primed preaction system, according to a further embodiment of the present disclosure, will now be described, wherein the same reference numerals are utilized to represent the same or similar components as described above. The pre-primed preaction system is provided in a dwelling or other building, which can include a residential home, multi-dwelling unit, commercial or industrial building and includes a pressurized water supply 12 that supplies water or, alternatively, other fire suppressant liquids to a plurality of sprinkler heads of a sprinkler head and piping distribution network 14. The plurality of sprinkler heads 14 are preferably appropriately spaced throughout the dwelling. The sprinkler head and piping distribution network 14 can also include an automatic air vent, as is known in the art. A connection system 16 is provided for connecting the pressurized liquid supply 12 to the piping distribution network and sprinkler heads 14.

The connection system 16 includes a flow control (angle style deluge) valve 18' connected to the pressurized water supply 12 by a main supply line 20. A manual supply valve 22 can be provided in the main supply line 20 in order to manually interrupt supply of the pressurized water supply 12 to the flow control valve 18'. A restricted liquid supply passage 24 is also connected to the pressurized water supply 12 and to the sprinkler heads and piping distribution network 14 in order to supply the sprinkler heads with a relatively low pre-primed pressure of liquid suppressant.

A check valve 26 is provided to prevent the backflow of liquid suppressant from the sprinkler heads and piping distribution network 14. The one-way check valve 26 is connected to the outlet 28 of the flow control valve 18' and to the restricted liquid supply passage 24. The one-way check valve 26 can include a system pressure gauge and valve 26*a* for detecting the downstream pressure and a pressure gauge and valve 26*b* for detecting upstream pressure. A system main drain valve 27 allows the piping distribution network 14 to be drained. The restricted liquid supply passage 24 is provided with a prime line valve 30 that allows manual shut-off of the restricted liquid supply passage 24. A check valve 32 is provided downstream from the prime line valve 30 in order to prevent reverse flow of liquid suppressant in the restricted liquid supply passage 24. A strainer 34 can also be provided in order to remove debris from the liquid suppressant in order to prevent clogging of the restricted liquid supply passage 24. The strainer 34 can be provided with a clean-out access to allow easy maintenance of the strainer 34 to make sure that the strainer 34 does not itself become clogged. A restricted orifice 36 is provided downstream from the strainer 34 and restricts the flow of liquid suppressant through the restricted liquid supply passage 24. A priming pressure water gauge and valve 37 is provided in communication with the restricted liquid supply passage 24.

A control passage 38 is provided in connection with the restricted liquid supply passage 24 and a prime chamber 40 of flow control valve 18'. The control passage 38 is provided with a pressure operated relief valve 42. A drip check reset valve 46 is provided in communication with the control passage 38 and is in communication with a drain 48.

A maintenance valve 50 can be provided in the restricted liquid supply passage 24 downstream from the control passage 38. The maintenance valve 50 can be manually operated for shutting off the restricted liquid supply passage at a location downstream from the control passage 38, to allow maintenance to be performed downstream thereof if necessary. A check valve 52 is provided downstream of the maintenance valve 50 and a maintenance orifice 54 can also be provided in the restricted liquid supply passage 24 downstream of the check valve 52.

A normally open solenoid valve 56 is provided in the restricted liquid supply passage 24 at a location downstream from the control passage 38 and prior to the check valve 26.

A flow test drain passage 60 is provided in communication with a drain port 62 in communication with the inlet chamber 21 of the flow control valve 18. A flow test valve 64 is provided in the flow test drain passage 60 which communicates with drain 48. Flow test drain valve 64 can be manually operated to divert flow from the pressurized water supply 12 to the drain 48.

A supervisory passage 66 can be provided in communication with restricted liquid supply passage 24 at a location downstream of the normally open solenoid 56 and in communication with a port 68 provided in communication with the check valve 26. A supervisory pressure switch 72 is in communication with the supervisory passage 66. The supervisory passage 66 is provided with a manually controlled supervisory alarm test valve 120 and a pressure relief valve 121 can also be provided. By opening alarm test valve 120, a pressure drop should be detected by supervisory pressure switch 72 which can be confirmed by an operator testing the system. A pilot pressure regulating valve 122 can also be utilized to regulate the pressure of the restricted liquid supply passage 24. A by-pass line 126 including a by-pass isolation valve 128 can also be provided in communication with the water supply 12 and restricted liquid supply passage 24.

An alarm pressure switch 130 can be provided in an alarm passage 131 in connection with the prime chamber 40 of the flow control valve 18 and/or a water motor alarm 132 can be utilized in connection with the alarm passage 131. A strainer 133 can be provided up-stream of the water motor alarm 132. The alarm pressure switch 130 detects a reduction of pressure in the liquid suppressant supplied to the prime chamber 40 of the flow control valve 18', and provides an appropriate signal to the control panel 90. A normally closed alarm test valve 134 and a normally open alarm shut off valve 136 are provided for testing and for isolating the alarm system. A drain check valve 138 is provided between a normally closed auxiliary drain valve 140 and the alarm test valve 134. A water supply pressure gauge and valve 142 is provided in the alarm passage 131.

An emergency release passage 78 is provided in communication with an emergency release port 80 which communicates with the prime chamber 40 of the flow control valve 18'. The emergency release passage 78 is provided with an emergency release valve 82 that can be manually operated to permit the flow of liquid suppressant to the drain 48. A normally closed solenoid valve 84 is also provided in communication with the restricted liquid supply passage 24 and can be controlled to an open position to allow drainage of liquid suppressant from the restricted liquid supply passage 24 to the drain 48.

A main electrical system is provided, including a main breaker panel 90 which can include the residential or commercial main breaker panel, or a supplementary main breaker panel dedicated to the sprinkler system. A plurality of smoke detectors and/or heat detectors 92 are provided in electrical connection with the main breaker panel 90. It should be understood that the smoke detectors and/or heat detectors 92 provide presently known fire detection mechanisms, although other fire detection mechanisms may be utilized with the present disclosure. The fire detection mechanisms 92 are electrically connected to the control panel 90. The main control panel 90 provides an activation current to normally closed solenoid valve 84 to open the valve 84 to allow drainage of the restricted liquid supply passage 24 to the drain 48. The main breaker panel 90 also provides a signal to the flow alarm device, such as a bell or light indicator or other known alarm mechanism 96 for indicating to the dwelling inhabitants that the sprinkler heads and piping distribution network 14 have been pressurized to a preaction pressure. The operation of the connection system 16 of FIG. 4 is generally the same as described above with respect to FIG. 1, with the addition of multiple pressure gauges, testing, draining and maintenance features as described.

What is claimed is:

1. A fire protection sprinkler system, comprising:

a single pressurized liquid supply having a pressurized liquid;

a plurality of sprinkler heads connected to a piping network for distributing said pressurized liquid;

means for connecting said single pressurized liquid supply to said piping network and said plurality of sprinkler heads in a first mode so as to provide said piping network and said plurality of sprinkler heads with a first pre-primed flow of said pressurized liquid and in a second mode so as to provide said piping network and said plurality of sprinkler heads with a second preaction flow of said pressurized liquid, said pre-primed flow of said pressurized liquid being restricted as compared to said preaction flow of said pressurized liquid, wherein said first pre-primed flow is diverted to allow said second preaction flow in said second mode.

2. The fire protection sprinkler system according to claim 1, further comprising a smoke detector wherein said second mode is activated by activation of said smoke detector.

3. The fire protection sprinkler system according to claim 1, further comprising a heat detection device wherein said second mode is activated by activation of said heat detection device.

4. The fire protection sprinkler system according to claim 1, wherein said means for connecting includes a restricted liquid supply passage connecting said single pressurized liquid supply with said piping network for supplying said pressurized liquid at said first pre-primed flow to said piping network.

5. The fire protection sprinkler system according to claim 4, wherein said second mode is activated by a loss of electrical power and a pressure reduction in said restricted liquid supply passage.

6. The fire protection sprinkler system according to claim 1, wherein said means for connecting includes a control valve provided in a closed position in said first mode.

7. The fire protection sprinkler system according to claim 6, wherein said control valve is opened in said second mode.

8. The fire protection sprinkler system according to claim 7, wherein said control valve includes a prime chamber that receives said first pre-primed flow for holding said control valve in said closed position.

9. The fire protection sprinkler system according to claim 8, wherein said means for connecting includes a normally open solenoid valve communicating said first pre-primed flow with a check valve that is connected to said piping network.

10. The fire protection sprinkler system according to claim 8, wherein said control valve includes a valve member disposed in said prime chamber, said valve member having a larger effective surface in said prime chamber than in an adjacent inlet chamber area to provide a larger pressure hydraulic ratio on a prime chamber side of said valve member as compared to an inlet chamber side of said valve member.

11. The fire protection sprinkler system according to claim 8, wherein said means for connecting includes a restricted liquid supply passage connecting said single pressurized liquid supply with said piping network and with said prime chamber of said control valve.

12. The fire protection sprinkler system according to claim 11, wherein said restricted liquid supply passage includes a normally closed solenoid valve operable to an open position to provide said diverted flow of said pressurized liquid out of said restricted liquid supply passage away from said piping network.

13. The fire protection sprinkler system according to claim 11, wherein said restricted liquid supply passage includes a normally open solenoid valve operable to a closed position to interrupt flow from said restricted liquid supply passage to said piping network.

14. A fire protection sprinkler system, comprising:

a single pressurized liquid supply having a pressurized liquid;

a plurality of sprinkler heads connected to a piping network for distributing said pressurized liquid; and a control valve operable between a closed position and an opened position for connecting said pressurized liquid from said single pressurized liquid supply to said piping network and said plurality of sprinkler heads, said piping network and said plurality of sprinkler heads being connected to a restricted liquid supply that is connected to said pressurized liquid and that maintains said control valve in a closed position until the restricted liquid supply is interrupted.

15. The fire protection sprinkler system according to claim 14, further comprising a fire detection system including at least one of a smoke detector or a heat detection device for providing a signal indicative of a detected fire, wherein said restricted liquid supply includes a normally open solenoid valve that activates closed in response to a pressure loss in said restricted liquid supply and a lack of a signal indicative of a detected fire thereby maintaining said control valve in a closed position.

16. The fire protection sprinkler system according to claim 14, wherein said control valve includes a prime chamber in communication with a control passage that communicates between said prime chamber and said restricted liquid supply.

17. The fire protection sprinkler system according to claim 14, further comprising a fire detection system including at least one of a smoke detector or a heat detection device for providing a signal indicative of a detected fire, wherein said restricted liquid supply includes a normally closed solenoid valve that opens in response to a signal indicative of a detected fire for causing a loss of pressure in said restricted liquid supply passage.

18. The fire protection sprinkler system according to claim 17, wherein said loss of pressure in said restricted liquid supply passage causes said control valve to move to said opened position.

19. The fire protection sprinkler system according to claim 18, wherein said restricted liquid supply passage includes a pressure operated relief valve that when opened connects said restricted liquid supply passage to a drain, said pressure operated relief valve being operable in response to a pressure increase resulting from an opening of said control valve.

20. The fire protection sprinkler system according to claim 14, further comprising a fire detection system including at least one of a smoke detector or a heat detection device for providing a signal indicative of a detected fire, wherein said restricted liquid supply passage includes a normally open solenoid valve and a supervisory pressure switch for sensing a pressure in said restricted liquid supply passage, said supervisory pressure switch being operable to close at a predetermined pressure to thereby close said normally open solenoid valve.

21. The fire protection sprinkler system according to claim 14, further comprising a smoke detector wherein said control valve is opened in response to activation of said smoke detector.

22. The fire protection sprinkler system according to claim 14, further comprising a heat detection device wherein said control valve is opened in response to activation of said heat detection device.

23. The fire protection sprinkler system according to claim 14, wherein said control valve is opened in response to a loss of electrical power and a pressure reduction in said restricted liquid supply passage.

24. The fire protection sprinkler system according to claim 14, wherein said restricted liquid supply passage includes a normally open solenoid valve communicating said restricted liquid supply passage with a check valve that is connected to said piping network.

25. The fire protection sprinkler system according to claim 16, wherein said control valve includes a valve member disposed in said prime chamber, said valve member having a larger effective surface in said prime chamber than in an adjacent inlet chamber area to provide a larger pressure hydraulic ratio on a prime chamber side of said valve member as compared to an inlet chamber side of said valve member.

26. The fire protection sprinkler system according to claim 14, wherein said restricted liquid supply passage includes a normally closed solenoid valve operable to an open position to divert flow out of said restricted liquid supply passage away from said piping network.

27. The fire protection sprinkler system according to claim 14, wherein said restricted liquid supply passage includes a normally open solenoid valve operable to a closed position to interrupt flow from said restricted liquid supply passage to said piping network.

28. A fire protection sprinkler system, comprising:

a single pressurized liquid supply having a pressurized liquid;

a plurality of sprinkler heads connected to a piping network for distributing said pressurized liquid;

a control valve fluidly connecting said single pressurized liquid supply to said piping network and said plurality of sprinkler heads at a preaction flow, said control valve operable between a closed position preventing said preaction flow and an opened position allowing;

a restricted liquid supply fluidly connecting said single pressurized liquid supply to said piping network and said plurality of sprinkler heads at a pre-primed flow, wherein said pre-primed flow maintains said control valve in said closed position; and a fire detection and control system including at least one of a smoke detector or a heat detection device for providing a signal indicative of a detected fire, wherein upon detection of a fire, said fire detection and control system will cause said control valve to move to said opened position.

29. The fire protection sprinkler system according to claim 28, wherein said restricted liquid supply includes a normally closed solenoid valve connecting said restricted liquid supply to a drain, wherein upon detection of a fire, said fire detection and control system causes said normally closed solenoid valve to open to divert flow through said restricted liquid supply to said drain and thereby release pressure from a back pressure chamber of said control valve to allow said control valve to move to said opened position.

30. The fire protection sprinkler system according to claim 28, further comprising an alarm device activated in response to flow through said control valve.

31. The fire protection sprinkler system according to claim 28, wherein said restricted liquid supply includes a normally open solenoid valve connecting said restricted liquid supply to said piping network, said fire detection and control system causes said normally open solenoid valve to close in response to a reduction in pressure in said restricted liquid supply and a lack of a signal indicative of a detected fire.

32. A fire protection sprinkler system, comprising:

a single pressurized liquid supply;

a plurality of sprinkler heads connected to a piping network;

a control valve operable between a closed position and an opened position for connecting said single pressurized liquid supply to said piping network;

a restricted liquid supply connected between said single pressurized liquid supply and said piping network and said plurality of sprinkler heads, said restricted liquid supply providing pressure to said control valve for holding said control valve in a closed position, wherein said control valve is moved to said opened position in response to a loss of electrical power and a pressure reduction in said restricted liquid supply; and a supervisory pressure switch attached to said restricted liquid supply for closing a normally open solenoid valve in said restricted liquid supply in response to a pressure reduction in said restricted liquid supply.

* * * * *